US006790577B1

(12) United States Patent
Nakamura

(10) Patent No.: US 6,790,577 B1
(45) Date of Patent: Sep. 14, 2004

(54) TONER FOR ELECTROSTATICALLY CHARGE IMAGE DEVELOPMENT

(75) Inventor: Toru Nakamura, Abiko (JP)

(73) Assignee: Ticona GmbH (DE)

( * ) Notice: Subject to any disclaimer, the term of this patent is extended or adjusted under 35 U.S.C. 154(b) by 0 days.

(21) Appl. No.: 10/258,210

(22) PCT Filed: Apr. 27, 2000

(86) PCT No.: PCT/JP00/02782

§ 371 (c)(1),
(2), (4) Date: Nov. 4, 2002

(87) PCT Pub. No.: WO01/84248

PCT Pub. Date: Nov. 8, 2001

(51) Int. Cl.[7] ..... G03G 9/093; G03G 9/087
(52) U.S. Cl. ..... 430/109.3; 430/108.8; 430/110.2
(58) Field of Search ..... 430/108.8, 110.2, 430/109.3

(56) References Cited

U.S. PATENT DOCUMENTS 4,265,994 A 5/1981 Hasegawa et al.
5,324,616 A 6/1994 Sacripante et al.
6,013,404 A * 1/2000 Feng et al. ..... 430/110.2

FOREIGN PATENT DOCUMENTS

EP 0978766 2/2000

* cited by examiner

*Primary Examiner*—Janis L. Dote
(74) *Attorney, Agent, or Firm*—Connolly Bove Lodge & Hutz LLP

(57) ABSTRACT

A toner for developing an electrostatically charged image, which is constituted with a microcapsule toner particle composed of a core and a shell, the core comprising a colorant and a binder resin containing an olefin copolymer having a cyclic structure, said olefin copolymer having a glass transition temperature ranging from −20° C. to less than 60° C. and a number average molecular weight ranging from 100 to 20,000, and the shell comprising a coating resin for the core, and/or a shell comprising a resin for coating the core containing an olefin copolymer having a cyclic structure, said olelin copolymer having a glass transition temperature ranging from 60° C. to 180° C. and a number average molecular weight ranging from 1,000 to 100,000. Since this toner is excellent in anti-spent toner effect, transfer properties, fixing ability, and offset-free properties, it is applicable to electrostatically charge image type copiers, printers, etc. of the low-temperature heating fixing type or pressure fixing type and heat roller fixing type which enables high-speed copying.

15 Claims, No Drawings

TONER FOR ELECTROSTATICALLY CHARGE IMAGE DEVELOPMENT

FIELD OF THE INVENTION

The present invention relates to a toner for developing an electrostatically charged image in pressure fixing type and heat roller fixing type (also referred to hereinafter as "pressure heating type" or "pressure heating system").

More specifically, this invention relates to a practically applicable toner type developing agent of the dry one-component magnetic type, dry one-component nonmagnetic type, dry two-component type, liquid dried type, or liquid type that can be pressure fixed onto film or other substrates to be copied, has adequate fixing properties (hereinafter referred to as "fixing ability"), toner spent properties, and transparency to enable pressure fixing at a low temperature of less than 100° C. even in the case of heat roller fixing, can form sharp images, and is excellent in high-speed fixing ability and preservation stability, thereby enabling to secure an adequate temperature range in which offset phenomena will not occur (hereinafter referred to as "offset-free temperature range").

This invention also concerns the above-mentioned toner that can be applied widely in copiers, printers, facsimile machines, color copiers, color laser copiers, color laser printers, and high speed electrophotographic printers.

BACKGROUND ART

With recent rapid spread of office automation, there have been growing demands, in electrostatically charged image developing copiers and printers, for higher resistance to mechanical impact for accommodating to high-speed printing and demands for high grade images, in other words, sharpness, low-temperature fixing ability and excellent light transmittance for accommodating to color toners.

Such needs for high speed copying and high grade images require to secure the necessary and adequate toner particle strength and a wide offset-free temperature range that enables practical applications at low temperatures. Furthermore, it is expected to realize the oil-free type copying methods, which do not require oil feeding to the fixing roll and thus bring no problem of soiling the substrates to be copied.

Under these circumstances, the present inventor found and discloses in JP-A-2000-66438 that a toner for developing a heat roller fixing type electrostatically charged image comprising a polyolefin resin having a cyclic structure as the binder resin and adopting a suitable combination of fatty acid amide wax, oxidized polyethylene wax, polyethylene wax and acid-modified polypropylene wax so as to impart various functions, can answer the above demands.

This toner, however, has limits in terms of the copying speed and fixing temperature in heat roller fixing applications. Meanwhile, the market has recently been demanding even higher copying speeds and adequate accommodations for demands for low-temperature fixing due to the need of saving electric power.

In forming full color images with three or four colors (Y: yellow, M: magenta, C: cyan, B: blue) added and mixed by the electrophotographic method, the process of transfer onto the substrate to be copied needs a toner particle which is infinitely close to sphere or true sphere and has smooth surface conditions.

However, the conventional mechanical milling method and air impact milling method using a high-velocity air flow could hardly be successful in preparing toners that were spherical and had smooth surfaces.

In heat roller fixing systems which are currently and generally used for fixing a full-color image onto paper, OHP film, or other substrates to be copied, an excessive amount of heat must be supplied to fix a three- or four-color toner, and silicone oil or the like should also be supplied to the fixing roller to prevent transfer of toner onto the heat roller (so-called "offset phenomenon").

Performances required of a toner are diverse and include charging properties, fixing ability, wear resistance, conveyability, preservation stability (the tendency of toner particles not to agglomerate mutually and form lumps even after a long period of time), etc. However, a toner obtained by dry mixing in a conventional compounding method is not satisfactory in meeting all such needs.

In order to answer each of the above needs, a toner must be provided with various conflicting functions. In order to solve such problems, microcapsule toners having a structure in which a core material (core substance) particle called "core" is encapsulated with a shell material (shell substance) called "shell" have been being proposed. For example, a binder resin which has a good fixing ability, but tends to give rise to the offset phenomenon due to poor preservation stability may be used as the core material, and a coating resin which has good preservation stability and offset-free property may be used as the shell material, thereby satisfying the conflicting demands.

Ideas have been proposed concerning such function-separated type microcapsule toners. For example, JP-A-9-292735 discloses a film fixing heating type image forming device that uses a microcapsule toner prepared by a suspension polymerization method. JP-A-59-53856 and JP-A-59-61842 disclose examples prepared by the similar method.

Also, JP-B-56-13945 proposes a preparation method based on the spray drying method; JP-B-8-16793 proposes a preparation method based on the water-drop phase separation method; and JP-A-3-56970 proposes a preparation method in which the shell layer is formed by an in situ polymerization method and to get microparticles using a high-pressure homogenizer.

Besides the above, interfacial polymerization methods, coacervation methods, dry capsule methods, etc. have also been introduced.

However, these prior art techniques, except for the spray drying method, use water as a medium, thus rendering the drying process troublesome. Therefore, they were inadequate for producing microcapsule toners at an industrial scale.

Also, the spray drying method had a difficulty in obtaining uniform particulates of the desired average particle diameter, usually of 10 $\mu$m or less.

DISCLOSURE OF THE INVENTION

An object of the present invention is to provide a microcapsule toner which can be adequately used in a low-temperature heat fixing system or in a pressure fixing system that enables high speed copying, as well as in a heat roller fixing system, solves the problems of prior-art microcapsules, and yet is excellent in preservation stability and prevention of the offset phenomenon.

The present inventor has completed this invention upon finding that the above-described problems can be solved by using two types of olefin copolymers, each having a cyclic structure but differing in glass transition temperature and number average molecular weight, one being used as a binder resin for the core and the other as a resin in the shell for coating the core (coating resin), of a microcapsule toner particle.

More specifically, this invention provides a toner for developing an electrostatically charged image which comprises a microcapsule toner particle composed of a core and a shell, the core comprising a colorant and a binder resin containing an olefin copolymer having a cyclic structure, said olefin copolymer having a glass transition temperature ranging from −20° C. to less than 60° C. and a number average molecular weight ranging from 100 to 20,000, and the shell comprising a resin for coating the core.

The invention also provides a toner for developing an electrostatically charged image which comprises a microcapsule toner particle composed of a core comprising a colorant and a binder resin; and a shell comprising a resin for coating the core containing an olefin copolymer having a cyclic structure, said olefin copolymer having a glass transition temperature ranging from 60° C. to 180° C. and a number average molecular weight ranging from 1,000 to 100,000.

The invention furthermore provides a toner for developing an electrostatically charged image which comprises a microcapsule toner particle composed of a core and a shell, the core comprising a colorant and a binder resin containing an olefin copolymer having a cyclic structure, said olefin copolymer having a glass transition temperature ranging from −20° C. to less than 60° C. and a number average molecular weight ranging from 100 to 20,000, and the shell comprising a resin for coating the core containing an olefin copolymer having a cyclic structure, said olefin copolymer having a glass transition temperature range from 60° C. to 180° C. and a number average molecular weight ranging from 1,000 to 100,000.

The present invention shall now be described more in detail.

[A] Materials Composing the Core of the Microcapsule Tonerparticle

The core comprises a binder resin and a colorant as the essential components. It optionally contains additives such as a function imparting agent, a charge controlling agent and other additives.

(1) Binder Resins

The below-mentioned binder resins for heat fixing and for pressure fixing or olefin copolymers having a cyclic structure are used as a binder resin which constitutes, along with a colorant, the core of the microcapsule toner. These resins have a lower melting point or softening point and a higher fixing ability in comparison to the below-mentioned coating resins which constitute the shell.

Examples of binder resins for heat fixing include styrene polymers such as polystyrene, substituted polystyrene, etc.; styrene copolymers such as styrene-acrylic ester copolymer, styrene-methacrylic ester copolymer, styrene-acrylonitrile copolymer, etc.; acrylic acid resins such as poly(meth) acrylic acid resin, poly(meth)acrylic ester resin, etc.; polyester resins; and epoxy resins. These resins can be used alone or in combination of two or more.

Examples of binder resins for pressure fixing include waxes. The waxes include vegetable, animal, mineral, and petroleum waxes such as carnauba wax, candelilla wax, lanolin, beeswax, montan wax, paraffin wax, microcrystalline wax, etc; higher fatty acid derivatives such as polyvalent alcohol esters, e.g., with stearic acid, palmitic acid, oleic acid, lauric acid, etc., and metal salts of higher fatty acids, e.g., calcium stearate, zinc stearate, lead stearate, magnesium stearate, etc.; polyolefin waxes such as polyethylene wax, polypropylene wax, etc.; olefinic homopolymers and copolymers such as ethylene-(meth)acrylic acid copolymer, ethylene-(meth)acrylic ester copolymer, ethylene-vinyl acetate copolymer, ionomer resin, etc.; styrene resins such as low molecular weight polystyrene, styrene-butadiene copolymer, styrene-acrylonitrile copolymer, etc.; epoxy resins, and polyester resins. These resins can be used alone or in combination of two or more.

Employing a low-temperature fixing system to enable high-speed copying and obtain a sharp, high-grade image requires a reliable fixing ability that can accommodate for a pressure heat fixing (heat pressure fixing) system. Therefore, the types and compositions of the binder resins suitable for the fixing methods should be selected.

In order to provide a high offset-free property by broadening the offset-free temperature range in which the offset phenomenon will not occur, it is preferable to use the below-described olefin copolymer having a cyclic structure (hereinafter Cyclic Olefin Copolymer; also abbreviated as COC) as the binder resin of the core material, in place of the above-mentioned binder resins for heat fixing and pressure fixing.

In order to provide the cyclic olefin copolymer used as the core with a more advanced fixing ability than that of the shell, the olefin copolymer is required to have a glass transition temperature (Tg) ranging from −20° C. to less than 60° C. and a number average molecular weight (Mn) ranging from 100 to 20,000. Tg of less than −20° C. will cause high viscoelasticity and render the printed image sticky, while Tg of 60° C. or higher will provide an insufficient fixing property due to excess rigidity. Also, Mn of less than 100 will not provide a sufficient fixation, while Mn exceeding 20,000 will make a resin hardly soluble in a solvent, thus being improper for practical use.

Here, the glass transition temperature (Tg) refers to the temperature at the middle point of the displacement showing the heat of transition as measured by the differential scanning calorimetry method (DSC). The number average molecular weight (Mn) is the value measured by gel permeation chromatography (GPC) and based on calibration by standard polyethylene or polystyrene. More specifically, the number average molecular weight is the value obtained by measuring under the following conditions.

[Conditions]

Column used: JORDI-SAEULE 500×10 LINEAR

Mobile phase: 1,2-dichlorobenzene (135° C.), flow rate: 0.5 ml/min

Detector: Differential refractometer

The cyclic olefin copolymer (COC) shall now be described in detail below.

The cyclic olefin copolymer (COC) is a copolymer of a lower alkene with 2 to 12 carbons, preferably 2 to 6 carbons, such as an α-olefin (or more broadly, non-cyclic olefins), e.g., ethylene, propylene, butylene, etc., and a cyclic and/or polycyclic compound (cyclic (cyclo) olefin) with 3 to 17 carbons, preferably 5 to 12 carbons having at least one double bond, such as norbornener tetracyclododecene, dicyclopentadiene, cyclohexene, etc., preferably norbornene or tetracyclododecene. Such a copolymer is colorless and transparent and has a high light transmittance.

The COC is prepared by polymerization methods using a metallocene catalyst system, a Ziegler catalyst system, a catalyst for metathesis polymerization, that is, a catalyst for a double bond opening and a ring opening polymerization reaction.

Synthesis examples of olefin copolymers with the above structure are disclosed in JP-A-5-339327, JP-A-5-9223, JP-A-6-271628, EP-A-203799, EP-A-407870, EP-A-283164, EP-A-156464, and JP-A-7-253315.

According to the above literatures, the cyclic olefin copolymer can be prepared by copolymerizing one or more types of monomers of the above, optionally with one type of the above non-monomer, in the presence of aluminoxane or other cocatalysts, and at least one type of metallocene catalyst comprising for example zirconium or hafnium, at a temperature of −78 to 150° C., preferably 20 to 80° C. and at a pressure of 0.01 to 64 bars. EP-A-317262 describes other useful polymers. A hydrogenated polymer or a copolymer of styrene and dicyclopentadiene may also be used.

A metallocene catalyst is activated when dissolved in an inert hydrocarbon, such as an aliphatic or aromatic hydrocarbon. For example, a metallocene catalyst is dissolved in toluene to be preactivated, whereby a reaction is carried out in the solvent.

The important features of the cyclic olefin copolymer reside in a softening point, a melting point, viscosity, dielectric properties, offset-free temperature range, and transparency. These can be adjusted by effectively selecting a monomer/comonomer ratio, that is, a ratio of the monomer units in the copolymer, molecular weight, molecular weight distribution, a hybrid polymer, blending, and additives.

The molar ratio of the non-cyclic olefin and the cyclic olefin charged for the reaction may be varied within a wide range depending on the target cyclic olefin copolymer, and is preferably adjusted to 50:1 to 1:50, and especially preferably 20:1 to 1:20.

For example, when two components, ethylene as a non-cyclic olefin and norbornene as a cyclic olefin, are used for the reaction to produce a cyclic olefin copolymer, the glass transition temperature (Tg) of the reaction product is largely influenced by the ratio of these components used. When the norbornene content increases, the Tg tends to increase as well. For example, a composition wherein the norbonene content is 15 mole % or less (ethylene content 85 mole % or more) can provide a copolymer whose Tg is from −20° C. to 60° C. On the other hand, a composition wherein the norbonene content is 15 mole % or more can provide a copolymer whose Tg is from 60° C. to 180° C. Physical properties such as the number average molecular weight are adjusted according to the known methods in the literatures.

The composition of the olefin copolymer having a cyclic structure used in the present invention is as follows The binder resin for the core is preferably composed of an unmodified cyclic olefin polymer and an acid-modified cyclic olefin polymer at a weight ratio of from 95:5 to 5:95.

The unmodified cyclic olefin polymer has a number average molecular weight (Mn; measured as a standard polyethylene based value by GPC, the same applies hereinafter) of from 100 to 20,000, preferably from 1,000 to 10,000, a weight average molecular weight (Nw) of from 200 to 40,000, preferably from 6,000 to 30,000, and a glass transition temperature (Tg) of from −20° C. to less than 60° C., preferably from 40° C. to 59° C.

Meanwhile, the acid-modified cyclic olefin polymer has a number average molecular weight (Mn) of from 100 to 20,000, preferably from 1,000 to 10,000, a weight average molecular weight (Mw) of from 300 to 80,000, preferably from 3,000 to 40,000, and a glass transition temperature (Tg) of from −20° C. to less than 60° C., preferably from 40° C. to 59° C.

In order to secure the fixing ability to be required and broaden the offset-free temperature range for practical use, the above cyclic olefin copolymer preferably comprises a low molecular weight polymer or polymer fraction (A) of low viscosity and a high molecular weight polymer or polymer fraction (B) of high viscosity, whose physical properties are described below.

More specifically, the olefin copolymer of the invention may be a mixture of polymer (A) and polymer (B); or may have a single-peak in a molecular weight distribution with a polymer fraction of a number average molecular weight of less than 7,500 and a polymer fraction of number average molecular weight of 7,500 or more; or may have two or more peaks in a molecular weight distribution wherein the polymer fraction corresponding to at least one peak has a number average molecular weight of less than 7,500 and the polymer fraction corresponding to the other peaks has a number average molecular weight of 7,500 or more.

The afore-mentioned composition of the olefin copolymer serves to broaden the offset-free temperature range at both the high and low temperature sides, thereby improving the toner fixing ability in high-speed copying, as well as the fixing properties at low temperatures and low pressures.

The polymer or polymer fraction (A) (referred to hereinafter as "component (A)") has

- a number average molecular weight (as measured based on standard polyethylene by GPC (gel permeation chromatography), the same applied hereinafter) of less than 7,500, preferably 1000 to less than 7,500, and more preferably 2,000 to less than 7,500;
- a weight average molecular weight of less than 15,000, preferably 1,000 to less than 15,000, and more preferably, 4,000 to less than 15,000;
- an intrinsic viscosity (i.v.; the intrinsic viscosity at 135° C. when 1.0 g of the polymer is dissolved uniformly in 100 ml of decalin) of less than 0.25 dl/g; and
- a glass transition temperature (Tg) of preferably less than 70° C.

The polymer or polymer fraction (B) (referred to hereinafter as "component (B)") has a number average molecular weight of 7,500 or more, preferably 7,500 to 50,000;

- a weight average molecular weight 15,000 or more, preferably 15,000 to 500,000; and
- an intrinsic viscosity (i.v.) of 0.25 dl/g or more.

Further, the content of component (B) is less than 50% by weight, preferably 5 to 35% by weight of the entire binder resin.

Component (B) provides a toner particle with the structural viscosity to enhance the offset preventing effect and adhesion onto paper, film, or other substrates to be copied. However, when the content of component (B) is 50% by weight or more, the uniform kneading property becomes drastically poor to damage the toner performance. In other words, a high quality image or a sharp image with high fixing strength and excellent heat response property becomes difficult to form or the mechanical milling properties become low, making it difficult to prepare a toner having the required particle diameter.

By the way, the polymer or polymer fraction used herein refers to polymer fractions of the cyclic olefin copolymer; where the olefin polymer is composed of a mixture of various components having different number average molecular weight, etc., the polymer or polymer fraction refers to each of the polymer components prior to mixing, while the polymer or polymer fraction refers to the polymer fractions obtained by separating the final synthesis product by GPC or other suitable means. When the polymer fraction is monodisperse or close to monodisperse, a number average molecular weight (Mn) of 7,500 corresponds approximately to a weight average molecular weight (Mw) of 15,000.

While the low-viscosity component (A) of the olefin copolymer contributes to broadening the offset-free temperature range at the low temperature side, the high viscosity component (B) contributes to broadening of the offset-free temperature range at the high temperature side. Thus, a high viscosity component (B) with Mn of 20,000 or more is desired to broaden the offset-free temperature range more effectively at the high temperature side.

The contents of components (A) and (B) should be 0.5 or more part by weight, preferably 5 to 100 parts by weight, respectively, based on the total amount of the binder resin defined as 100 parts by weight. Less than 0.5 part by weight each of both the components will not provide a broad offset-free temperature range suitable for practical use.

The high viscosity (high molecular weight) and low viscosity (low molecular weight) olefin copolymers having a cyclic structure have the number average molecular weights (Mn), weight average molecular weights (Mw), and intrinsic viscosity (i.v.) as mentioned above, and thus have the degree of dispersion of the molecular weight distribution indicated by Nw/Mn as low as 1–2.5, are monodisperse or close to monodisperse. This makes it possible to produce a toner having a high heat response and a high fixing strength, thereby enabling the fixing of toner at low temperatures and low pressures. This also contributes to preservation stability of the toner, spent toner properties, uniformity of charge distribution, and electirical stability by constant charge/discharge efficiency. It is especially preferable for the low viscosity polymer or polymer fraction to have monodispersity or substantail monodispersity, because the toner will then have excellent, so-called heat response properties, such as exhibition of instantaneous melting and setting, etc.

The olefin copolymer is also colorless, transparent, and has a high light transmittance. Thus, the olefin polymer can be applied adequately to color toners. For example, it has been confirmed that excellent transparency is obtained even when the azo pigment, "Permanent Rubin F6B" (manufactured by Clariant Co.) is added, followed by adequate kneading, and then sheets are made by a press machine. Also, measurements by the DSC method (differential scanning calorimetry method) have shown that the olefin copolymer has an extremely low heat of fusion. Thus, significant reduction of the amount of energy consumed for toner fixing can be anticipated.

Also, by introducing carboxyl groups in the olefin copolymer, the compatibility with other resins can be improved and the dispersion properties of the pigments in the toner can be improved. The introduction of carboxyl groups makes it possible to improve the adhesion of toner onto paper, film, or other copying medium and the fixing ability.

For introducing carboxyl groups, advantageously employed is a two-step reaction method in which the olefin copolymer having a cyclic structure is prepared first and then carboxyl groups are introduced.

At least two methods may be given for introducing carboxyl groups.

In one method, a methyl or other alkyl group at the end of the copolymer is oxidized and converted into a carboxyl group by the fusing air oxidation method. However, in the case of an olefin polymer prepared by using a metallocene catalyst, it is difficult to introduce many carboxyl groups by this method because such a polymer has only a few branches.

In another method, the olefin copolymer has a cyclic structure which comprises a core material that is modified by acrylic acid or maleic anhydride.

Another method is the method in which t-butanol peroxide or other peroxide is used as an initiator to graft polymerize maleic anhydride, acrylic acid, or methacrylic acid onto the olefin polymer having a cyclic structure so as to attain a graft ratio of 1 to 5% by weight, preferably 3 to 5% by weight in terms of weight ratio with respect to the olefin polymer.

The graft ratio of less than 1% by weight will be insufficient to achieve the improvement in the compatibility and the like. On the other hand, the graft ratio exceeding 5% by weight will raise intermolecular crosslinking in the olefin polymer to increase the molecular weight. This makes kneading and milling properties unsuitable for practical use. Further, a serious yellow discoloration and loss of transparency will occur. Thus, the polymer is unsuitable for a color toner that requires colorlessness and transparency.

In the same manner, the compatibility with other resins and the dispersion of the pigments in the toner can be improved by introducing a hydroxyl group or an amino group by a known method.

Also, a crosslinked structure can be introduced in the olefin polymer to improve the toner fixing property.

One method of introducing a crosslinked structure is terpolymerization of the non-cyclic olefin and the cyclic olefin with cyclopentadiene, cyclohexadiene, norbornadiene, tetracyclododecadiene, butadiene, or other diene monomer in synthesizing the above-described olefin polymer.

As a result of this method, the olefin polymer has a terminal showing an activity even without a crosslinking agent. A known chemical reaction such as oxidation or epoxidation, or the addition of a crosslinking agent to form a crosslinked structure results in the functioning of the olefin polymer.

Another method is to add a metal such as zinc, copper or calcium to the olefin polymer of a cyclic structure having carboxyl groups introduced therein, and then blend and melt the mixture with a screw to disperse the metal as fine particles in the olefin polymer, thereby forming an ionomer having a crosslinked structure. Concerning a technology itself on such an ionomer, U.S. Pat. No. 4,693,941, for example, discloses a terpolymer of ethylene containing carboxyl groups which may take the form of a divalent metal salt upon partial or complete neutralization in an attempt to obtain toughness.

JP-A-6-500348 reports a polyester resin molded product containing an ionomer of an unsaturated carboxylic acid prepared for the same purpose, in which approximately 20 to 80% of the carboxylic acid groups is neutralized with zinc, cobalt, nickel, aluminum or copper (II).

A cyclic olefin polymer, to which an acid-modified olefin polymer having a cyclic structure with carboxyl group introduced has been added at 5 to 95% by weight, may be used as the core material. This will be an effective means for securing the fixing ability and the offset-free temperature range.

(2) Colorants

Carbon black, diazo yellow, phthalocyanin blue, quinacridone, carmine 6B, monoazo red, perylene, or other colorants used for conventional monochromatic or color copier toners may be incorporated as the colorant in the core material.

(3) Function Imparting Agents

Various types of waxes may be used as a function imparting agent for broadening the offset-free temperature range and improving the offset-free property. At least one type of wax selected from polar waxes, such as amide wax, carnauba wax, higher fatty acids and esters thereof, higher fatty acid metal soaps, partially saponified higher fatty acid esters, and higher fatty acid alcohols; and nonpolar waxes, such as polyolefin waxes and paraffin wax, may be used as a function imparting agent.

Among the various waxes, fatty acid amide waxes, oxidized polyethylene waxes, and acid-modified polypropylene waxes are preferable from the viewpoint of achieving a broad offset-free temperature range.

In order to broaden the above-described offset-free temperature range of the toner and improve the toner performance, the wax is preferably used in the manner described below.

That is, two or more types of waxes, which have different melting points (the peak temperature in differential scanning calorimetry (DSC) measurements) in the range of 80 to 140° C., are preferably used in combination. If the melting point is less than 80° C., blocking due to low melting point substances will tend to occur. Meanwhile, since a function imparting agent is required to melt completely at the kneading temperature that exceeds the softening point of the binder resin, the upper limit of the wax is limited by the softening point (approximately 135 to 140° C.) of the olefin polymer having a cyclic structure which is the principal component of the binder resin and is preferably 140° C.

More specifically, two or more types of waxes selected from the fatty acid amide waxes and hydrocarbon waxes given below are used.

(i) Waxes Having Polar Groups

Waxes having polar groups include various fatty acid amide waxes, for example, arachic acid monoamide (melting point: 110° C.), behenic acid monoamide (melting point: 115° C.), N,N'-dioleyl sebacic acid amide (melting point: 115° C.), N,N'-dioleyl adipic acid amide (melting point: 119° C.), and N,N'-distearyl isophthalic acid amide (melting point: 129° C.); oxidized olefin waxes, for example, oxidized polyethylene wax (melting point: 116° C.); acid-modified polyolefin waxes, for example, acid-modified polypropylene wax (melting point: 138° C.); and carnauba wax (melting point: approximately 80° C.).

(ii) Nonpolar Waxes (Waxes Without Polar Groups)

Nonpolar waxes include olefin waxes which are hydrocarbon waxes, for example, polyethylene wax (melting point: 130° C.), polypropylene wax (melting point: 120 to 150° C.), paraffin wax (melting point: approximately 60 to 80° C.), sazole wax (solidifying point: approximately 98° C.), and microcrystalline wax (melting point: 80 to 100° C.).

The wax is incorparated in the binder resin that composes the core material and/or the coating resin that composes the shell material.

A silicone oil having mold release characteristics may be used as a function imparting agent for prevention of the offset phenomenon, in combination with an above-mentioned wax, as long as it does not adversely affect the effect of the present invention.

(4) Charge Control Agent

Nigrosine dyes, fatty acid-modified Nigrosine dyes, metallized Nigrosine dyes, metallized fatty acid-modified Nigrosine dyes, chromium complexes of 3,5-di-t-butylsalicylic acid, quaternary ammonium salts, triphenylmethane dyes, azochromium complexes, and other known charge control agents may be incorporated in the core material.

(5) Other Additives

In addition to the aforementioned toner components, if desired, a flowing agent such as silica micopower colloidal silia (including fumed silica), aluminum oxide or titanium oxide and a lubricant comprising a fatty acid metal salt such as barium stearate, calcium stearate or barium laurated may be incorporated in the core material, as long as they do not adversely affect the effect of the present invention.

(6) Amount of Components to be Incorporated

The amounts of the components to be incorporated in the core material of the invention are similar to those in the case of the toner for electrostatically charged image developing copiers and printers, and are shown in Table 1.

TABLE 1

General composition of toners (unit: wt. %)

| | Binder resin | Colorant | Charge control agent | Function Imparting agent | Magnetic powder | Solvent |
|---|---|---|---|---|---|---|
| Dry two-component toner | 50–100 | 0–20 | 0–10 | 0–20 | — | — |
| Dry nonmagnetic one-component toner | 50–100 | 0–20 | 0–10 | 0–20 | — | — |
| Dry magnetic one-component toner | 0–100 | 0–20 | 0–10 | 0–20 | 0–60 | — |
| Dry polymerized toner | 50–100 | 0–20 | 0–10 | 0–20 | — | — |
| Liquid dried toner | 15–50 | 0–10 | 0–5 | 0–10 | — | 50–70 |
| Liquid toner | 15–50 | 0–10 | 0–5 | 0–10 | — | 50–70 |

[B] Materials Constituting the Shell Material of the Microcapsule Toner Particles The shell material comprises a coating resin as the essential component and arbitrary additives such as a function imparting agent, a charge control agent, or the like. The coating resins used in the shell also have fixing ability, thus perform as binder resins similar to the aforementioned resins used in the core.

(1) Coating Resin

A resin for fixing or an olefin polymer having a cyclic structure described below is used as the coating resin that constitutes the shell of the microcapsule toner particles.

In comparison to the binder resin of the core material, the coating resins has a higher melting point or softening point and thus better preservation stability.

Examples of coating resins for fixing include homopolymers and copolymers of styrene, substituted styrenes, and derivatives thereof, (meth)acrylic acid, (meth)acrylic esters, maleic anhydride, maleic anhydride esters, and derivatives thereof, maleic anhydride amide, nitrogen containing vinyl compounds, such as vinyl pyridine, N-vinyl imidazole, etc., vinyl monomers, such as vinyl acetal, vinyl chloride, acrylonitrile, vinyl acetatel etc., vinylidene monomers, such as vinylidene chloride, vinylidene fluoride, etc., and olefin monomers, such as ethylene, propylene, etc., condensation polymers, such as polyesters, epoxy resins, polycarbonates, polyamides, polyurethanes, polyureas, rosin, modified rosin, phenol resins, melamine resins, polyphenylene oxides, and terpene resins, fatty hydrocarbon resins, fatty cyclic hydrocarbon resins, and petroleum resins, and such a resin may be used alone or in combination of two or more types.

In order to prevent the offset phenomenon, in which the toner is transferred onto the heat roller, and to improve the preservation stability further, the olefin polymer having a cyclic structure described below is preferably used as the coating resin of the shell material.

An unmodified olefin having a cyclic structure is preferable as the coating resin of the shell material. since the preservation stability of the toner will be secured adequately as long as the glass transition temperature (Tg) of the polymer used is 60° C. or more, the entire amount may be replaced by an acid-modified olefin polymer having a cyclic structure whose Tg is 60° C. or more.

Such an unmodified olefin polymer having a cyclic structure has a number average molecular weight (Mn) ranging from 1,000 to 100,000, preferably from 2,000 to 50,000, a weight average molecular weight (Mw) ranging from 2,000 to it 200,000, preferably from 4,000 to 100,000, and a glass transition temperature (Tg) ranging from 60° C. to 180° C., preferably from 60° C. to 80° C.

Meanwhile, the above-mentioned acid-modified olefin polymer has a number average molecular weight (Mn) ranging from 1,000 to 100,000, preferably from 2,000 to 50,000, a weight average molecular weight (MW) ranging from 3,000 to 300,000, preferably from 6,000 to 200,000 and a glass transition temperature (Tg) ranging from 60° C. to 180° C., preferably from 60° C. to 80° C.

If the glass transition temperature of the above-described olefin polymer is less than 60° C., there will be many problems in the preservation stability of the toner particles, and when the glass transition temperature is in the excess of 180° C., the melting point will be raised and the fixing ability will tend to be poor. Also, when the number average molecular weight of the above-described olefin polymer is less than 1,000, an adequate fixing strength cannot be obtained, while when the number average molecular weight exceeds 100,000, the required solubility in the solvent will be difficult to secure.

The modified substances, the crosslinked substances, and the various characteristics besides the glass transition temperature and number average molecular weight of the above-described olefin polymer having a cyclic structure are the same as those indicated above for the olefin polymer having a cyclic structure used in the core material, and descriptions thereof shall be omitted.

(2) Function Imparting Agents

In order to broaden the offset-free temperature range and further improve the offset-free property of the toner particle surface, the same function imparting agents (wax, silicone oil) as used in the above-described core material may also be incorporated in the shell material. The above-described preferable forms of use, etc. also can be applied to the function imparting agents to be incorporated in the shell material.

(3) Charge Control Agents

The same charge control agents used in the above-described core material may be incorporated in the shell material.

(4) External Additives

The surface of the shell material of the toner particles may be coated by an external additive as necessary.

Examples of external additives include flowing agents, such as colloidal silica (including fumed silica), aluminum oxide, titanium oxide, etc., and lubricants comprising a fatty acid metal salt, such as barium stearate, calcium stearate, barium laurate, etc., and such an external additive may be used alone or in combination of two or more types. It is preferable that these additives have been made hydrophobic.

The amount of external additive used is 0.01 to 10, preferably 0.05 to 5 parts by weight per 100 parts by weight of toner particles.

If the shell material is to be coated by an external additive, a solution containing the external additive is coated onto the surface of the particles or the external additive is adhered to the surface of the particles by other methods.

(5) Amount of the Components to be Incorporated

The amounts of the above-mentioned components, with the exception of the colorant to be incorporated, in 20 the shell material are as shown in Table 1 above.

[C] Microcapsule Toner Particle

The microcapsule toner particle has a capsule-like or so-called core-shell structure in which the core material is coated with the shell material.

The average particle size (diameter) of an entire particle is preferably 3 to 10 $\mu$m. and the thickness of the outer shell {[(outer diameter of capsule)−(diameter of core material)]×½} is preferably 0.1 to 0.5 $\mu$m.

According to this invention, there are the following three modes of combination of resins for the core material and the shell material.

(a) Core material: olefin polymer having a cyclic structure (−20° C.≦Tg<60° C., 100≦Mn ≦20,000)
Shell material: Coating resin for fixing (b) core material: Binder resin for heat fixing and binder resin for pressure fixing
Shell materials Olefin polymer having a cyclic structure (60° C.≦Tg≦180° C., 1,000≦Mn≦100,000)

(c) Core material: Olefin polymer having a cyclic structure (−2° C.≦Tg<60° C., 100≦Mn≦20,000)
Shell material: Olefin polymer having a cyclic structure (60° C.≦Tg≦180° C., 1,000≦Mn≦100,000)

A result of incorporating an olefin having a cyclic structure in at least either of the shell material or the core material in combination with the various crystalline and non-crystalline resins given as examples of the above-described fixing resins [A](1) and [B](1), which are relatively compatible with the olefin polymer, the transparency, low-temperature fixing ability, mechanical impact resistance, and other characteristics of the olefin polymer having a cyclic structure that are important in terms of toner performance can be exhibited.

With the mode (c), in which olefin polymers having a cyclic structure are used in both the shell material and core material, the above-mentioned characteristics become fully exhibited as toner performance.

The most preferable form of toner particles is one in which the following olefin polymer having a cyclic structure, that is, an ethylene-norboinene copolymer, with a glass transition temperature (Tg) ranging from 40 to 59° C., a number average molecular weight (Mn) ranging from 1,000 to 10,000, and a polydispersity (weight average molecular weight (Mw)/number average molecular weight (Mn)) of 10 or less and with which the copolymerization mole ratio of ethylene to norbornene is from 85/15 to 95/5, is used as the binder resin of the core material, and in which the following olefin polymer having a cyclic structure, that is, an ethylene-norbornene copolymer, which is soluble in methyl ethyl ketone (MEK), has a glass transition temperature (Tg) ranging from 60 to 80° C., a number average molecular weight (Mn) ranging from 2,000 to 50,000, and a polydispersity (Mw/Mn) ranging from 4 to 10 and with which the copolymerization mole ratio of ethylene to norbornene is from 75/25 to 85/15, is used as the coating resin of the shell material.

The microcapsule toner particle is preferably prepared by reprecipitation method. More specifically, it is the solvent reprecipitation method wherein a good solvent solution having the binder resin and the colorant dissolved therein is dropped into a poor-solvent solution of the coating resin of the shell material to cause the shell material to precipitate around the core material.

Microcapsule toner particles may also be prepared in accordance with a phase separation method as indicated for example in JP-B-08-16793 and JP-B2-2631019.

(1) Method of Preparation by the Reprecipitation Method (Solvent Reprecipitation Method)

After adding and dissolving 16 to 20% by weight of the olefin polymer having a cyclic structure that constitutes the core material and 1 to 2% by weight of a function imparting agent in 76 to 80% by weight of solvent (mixed solvent of toluene and cyclohexane, etc.) at a temperature of 25 to 30° C., 1 to 2% by weight of colorant is dispersed using a bead mill, etc. to prepare a solution (solution A).

On the other hand, a solution (solution B) is prepared by dissolving 1.8 to 2.2% by weight of the olefin polymer having a cyclic structure that constitutes the shell material and 0.015 to 0.025% by weight of a charge control agent in 98% by weight of MEK or other solvent.

In the next step, solution A is dropped from a nozzle with numerous orifices of 20 to 30 $\mu$m diameter into solution B with high velocity stirring to obtain a precipitate, which is then passed through a multiple stage filter of 2 $\mu$m, 0.5 $\mu$m, and 0.2 $\mu$m and thereby separating from the solvent. In the final stage, particles are formed by removing the residual solvent using a high-temperature vacuum dryer.

Microcapsule toner particles are thus obtained which are substantially spherical in shape, have an average diameter of 4 to 10 μm and a particle size distribution of 2 to 12 μm (corresponding to 3 σ where σ=standard deviation), and of which the thickness of the shell material is 0.2 to 0.5 μm (based on weight measurements by the solvent separation method).

Hydrophobic silica is then externally added to be rendered as a developer.

(2) Method of Preparation by the Phase Separation Method

An olefin polymer having a cyclic structure, acid-modified olefin polymer having a cyclic structure, wax, colorant, and charge control agent are melt kneaded. After microdispersing hydrophilic silica as a protective colloid with high-velocity stirring in hot water, solidification is performed by cooling rapidly with a large amount of water. The silica is then dissolved and removed by a basic aqueous solution and the core material particles are obtained by rinsing with water/methanol and then performing filtration.

Separately, an olefin polymer having a cyclic structure, wax, and charge control agent are dissolved in a ketone solvent, preferably MEK, a prescribed amount of the above-mentioned core material particles is dispersed with a homomixer, a prescribed amount of acetic acid is added, and then under deep cooling, water is dropped in at a prescribed rate to reprecipitate the shell material onto the surface of the core material particles.

Thereafter, rinsing with a mixed solution of water and methanol, filtration, and drying are performed to obtain microcapsule toner particles.

Hydrophobic silica is then externally added to be rendered as a developer.

From a comparison of the above-described two methods of preparation, it can be said that the reprecipitation method excels in being more suitable for industrial production in that a general purpose solvent of low cost is used and drying is performed more readily due to the difference in latent heat of the solvent and water, and there is less mutual agglomeration of the toner particles.

BEST MODES FOR CARRYING OUT THE INVENTION

Though this invention shall be described more in details by way of examples and comparative examples, these examples and comparative examples do not limit the effective scope of this invention at all.

Dry one-component toners and dry two-component toners were prepared as described below.

Examples 1 to 4 are examples of preparation of microcapsule toner by the reprecipitation method and Example 5 is an example of preparation of microcapsule toner by the phase separation method.

EXAMPLE 1

Preparation of Solution A (Core Material)

17% by weight of as "TOPAS® T-936" manufactured by Ticona GmbH and having a glass transition temperature (Tg) of 49° C. and a number average molecular weight (Mn) of 2,000 was used as the olefin polymer having a cyclic structure, 1% by weight of "TOPAS® AG-07" manufactured by Ticona GmbH and having a glass transition temperature (Tg) of 58° C. and a number average molecula weight (Mn) of 3,700 was used as the acid-modified olefin polymer having a cyclic structure, 0.5% by weight of "BNT22H" manufactured by Nippon Seika and 0.5% by weight of "CERIDUST® 3715" manufactured by Clariant were used as a function imparting agent, and these components were gradually added to and dissolved in 80% by weight of a mixed solvent of toluene and cyclohexane (weight ratio: 50:50) at a temperature of 30° C. and stirring velocity of 200 rpm.

Beads (stainless steel powder manufactured by Ashizawa, particle diameter: 500 μm) were then added to the above solution, and 1% by weight of a black colorant ("Carbon Black MA-7" manufactured by Mitsubishi Chemical) was gradually added and dispersed with a stirring velocity of 500 rpm to obtain solution A.

Preparation of Solution B (Shell Material)

2% by weight of "-Topas-TOPAS® AG-09" manufactured by Ticona and having a glass transition temperature (Tg) of 67° C. and a number average molecular weight (Mn) of 4,600 was used as the olefin polymer having a cyclic structure, and this was dissolved along with 0.02% by weight of a charge control agent ("Copy Charge NX" (trade name); manufactured by Clariant) in approximately 98% by weight of methyl ethyl ketone to obtain solution B.

Granulation Process

The above-described solution A was dropped from a nozzle with numerous orifices of 30 μm diameter into solution B with high-velocity stirring to form particles.

With regard to the rate of dropping, in the case where the particles are to be made in a kettle of 500 liter volume, 100 liters of solution A was graduallyadded by dropping from 100 orifices at a rate of 5 liters/min into 200 liters of solution B over 20 minutes to obtain a precipitate.

The stirring velocity of solution B was set to 2000 rpm, and the stirring was continued for 10 minutes after the completion of dropping of solution A. Thereafter, the precipitate was passed through a multiple stage filter of 2 μm, 0.5 μm, and 0.2 μm and thereby separating from the solvent, and then the residual solvent was removed by a high-temperature vacuum dryer to obtain microcapsule toner particles.

The average diameter of the toner particles obtained was approximately 6 μm and all particles were distributed within a particle size classification of 2 to 12 μm. Since size separation of coarse particles and very fine particles were not required, this method was found to be excellent in terms of productivity.

Observations by a scanning microscope confirmed that the particles have a substantially spherical shape, and the thickness of the shell material was calculated according to the below-described weight measurements by the solvent separation method to be 0.2 to 0.5 μm.

With regard to the yield of the toner, the yield after drying was 21.7 kg (yield of 92%) with respect to 100 liters (approximately 85.6 kg, of which the core material polymer comprised 17.1 kg) of solution A and 200 liters (approximately 162 kg, of which the shell material polymer comprised 6.5 kg) of solution B (total solids 23.6 kg).

The yields of the toner by means of the conventional mechanical milling method and the air impact air flow method which uses a high-velocity air flow were approximately 80% and approximately 75%, respectively, where ultramicroparticles of 1 μm or less are formed. It was thus found that the toner yield is improved significantly by the above-described method.

The average particle diameter of the toner particles was determined by a laser diffraction scattering type particle size distribution measurement device ("LA-700" manufactured by Horiba Seisakusho). The particle size distribution was also measured by the same device, and particles of 4 to 10 μm particle diameter were found to share 95% on a volume basis and 75% on a number basis.

For the measurement of the thickness of the shell material, 10 g of the toner particles were weighed out and placed in 1 liter of methyl ethyl ketone, and after dissolving the shell material by heating to 50° C. and stirring for 20 minutes, the solvent was removed by hot filtration and the remaining weight was measured to calculate the thickness of the shell material.

EXAMPLE 2

Except for using the yellow colorant "Yellow IG" (trade name) manufactured by Clariant as a colorant, microcapsule toner particles were obtained in the same manner as Example 1.

EXAMPLE 3

Except for using the magenta colorant "Pink EO2" (trade name) manufactured by Clariant as a colorant, microcapsule toner particles were obtained in the same manner as the Example 1.

EXAMPLE 4

Except for using the cyan colorant "Blue BO2G" (trade name) manufactured by Clariant as a colorant, microcapsule toner particles were obtained in the same manner as Example 1.

EXAMPLE 5

Microcapsule toner particles were prepared as described below by the phase separation method in reference to JP-B1-8-16793 and JP-B2-2631019.

Preparation of Core Material Particles

85% by weight of "TOPAS® T-936" manufactured by Ticona was used as the olefin polymer having a cyclic structure, 5% by weight of "TOPAS® AG-07" manufactured by Ticona was used as the acid-modified olefin polymer having a cyclic structure, 2% by weight of a behenic acid amide wax ("BNT22H" (trade name) manufactured by Nippon Seika) and 2% by weight of a mixed powder of oxidized and nonoxidized polyethylene wax ("CERIDUST® 3715" manufactured by Clariant) were used as function imparting agents, and these components, along with 5% by weight of a black colorant ("Carbon Black MA-7" manufactured by Mitsubishi Chemical) and I% by weight of a charge control agent ("Copy Charge NX" (trade name) manufactured by Clariant), were melt kneaded at 120° C. for 15 minutes with a kneader ("RHEOMIX 600" manufactured by Haake), and the mixture obtained was transferred to a stainless steel container equipped with a heater and maintained at 130° C.

Separately, water was placed in a homomixer (manufactured by Tokushu Kika) and heated to and maintained at approximately 95° C. 0.4% by weight of colloidal silica ("HDK N-30" manufactured by Wacker Chemie) were then added and dispersed adequately by stirring.

The rotation speed of the homomixer was set to 8,500 rpm, and approximately 15 parts by weight (phr) of the above-described melt mixture were added to the dispersion medium of hot water and then stirring was continued for approximately 15 minutes to form microparticles.

Thereafter, the dispersion was poured onto the ice prepared beforehand (of double the amount of the dispersion) to rapidly cool and solidify the microparticles. An amount of sodium hydroxide equivalent to the amount for neutralization of the colloidal silica was then added to the dispersion, stirring was performed with a propeller mixer for 24 hours under room temperature to dissolve the colloidal silica, and the basic solution and the solids were separated by a centrifugal filter.

The slurry was then rinsed with a water/methanol solution (50/50 wt. %), filtration was performed each twice, and drying was performed with a hot air dryer set to 40° C. to obtain the core material particles.

The volume average particle diameter of these is particles was approximately 8 μm (measured with "LA-700" manufactured by Horiba Seisakusho).

Preparation of Shell Material Solution

A shell material solution for capsulation was prepared using 95 parts by weight of the above-mentioned "TOPAS® AG-09" as the olefin polymer having a cyclic structure, 2 parts by weight of a behenic acid amide wax ("BNT22H" (trade name) manufactured by Nippon Seika) and 2 part by weight of a mixed powder of oxidized and non-oxidized polyethylene wax ("CERIDUST® 3715" manufactured by Clariant) as function imparting agent, 1 part by weight of a charge control agent ("Copy Charge NX" (trade name) manufactured by Clariant), and 2400 parts by weight of methyl ethyl ketone.

A homomixer was equipped to a reaction tank with jacket of 20 liter volume, 7.6 kg of the above-described solution was fed into the reaction tank, and after cooling to −25° C. with stirring, 120 g of acetic acid were fed and stirring was performed for 5 minutes.

2.0 kg of the above-described core material particles were then fed into the reaction tank and after dispersing adequately with a homomixer, and cold water of 0 to 5° C. was dropped at a dropping rate of 10 g/minute. The dropping rate was increased gradually to 100 g/minute at the final stage, and approximately 3 kg of water were added finally. The required time for this process was approximately 2 hours.

Thereafter, the capsulation solution was separated by a centrifugal filter and the capsule particles that were separated by filtration were rinsed twice with water/methanol (50/50% by weight), separated by filtration, and dried at 40° C.

The volume average particle diameter of the capsule particles was approximately 8.5 m which was thus clearly larger than that of the core material particles and the diameter was enlarged due to capsulation.

A substantially similar thickness of shell material (0.2 to 0.3 μm) was calculated by weight measurements by the above-described solvent separation method.

0.5 parts by weight of hydrophobic colloidal silica was added externally as a developer onto the microcapsule toner thus obtained.

COMPARATIVE EXAMPLE 1

A toner, which is a commercially available toner prepared by the air impact milling method (jet milling method) and to be more specific, is a toner for the copier "FT-5520" manufactured by Ricoh was used and performance evaluations were performed with the above-mentioned copier.

COMPARATIVE EXAMPLE 2

A toner, which is a commercially available toner prepared by the mechanical milling method, and to be more specific is the toner for the printer "MAGICOLOR® 2CX" manufactured by QMS was used and performance evaluations were performed with the copier "FT-5520" manufactured by Ricoh.

Actual copies were made with the copier "F-5520" manufactured by using the microcapsule toners obtained in the Examples 1 to 4 described above and the commercially available toners of the Comparative Examples 1 and 2. The results are as shown in Table 2.

(a) Anti-spent Toner Effect

Actual copying tests onto high-quality paper were performed using the toner samples of the respective examples and comparative examples. Copies were made until the toner components stuck to the developing sleeve and the photoconductor reached to the allowable limit amount, and comparisons were made with the number of sheets of paper that had been copied onto at that point.

(b) Transfer Properties

The efficiency of transfer from the photoconductor onto high-quality paper, which is the substrate to be copied, was measured based on the amount of toner recovered after performing copying onto 10,000 sheets.

(c) Fixing Ability

Imaging was formed on high-quality paper using each toner, an unprinted paper of the same quality was placed on the top of the printed paper and the printed image was rubbed with a rubbing tester to be transferred forcibly onto the unprinted paper.

The fixing rate for imaging was set to 150 mm/second and the fixing temperature was set at 150° C.

area (A) and at a part without an image (B) were measured, and the transmittance was indicated as A/B×100(%)

(e) Preservation Stability

After preserving the toner prepared by each procedure for 8 hours under the conditions of 60° C. and 50% RH (relative humidity), the toner was passed through a mesh of 100 mesh for a fixed period of time, and the value obtained by dividing the mesh residual with the amount of sample used was indicated in %. Agglomeration of toner particles during preservation will render this value higher. The agglomeration is caused mainly by the substances of low melting point of 50° C. or less contained in the toner composition. The symbol "o" indicates the mesh residual of 0.5% or less and "×" indicates the mesh residual exceeding 0.5%.

TABLE 2

| Item of evaluation | Example 1 | Example 2 | Example 3 | Example 4 | Example 5 | Comparative Example 1 | Comparative Example 2 |
|---|---|---|---|---|---|---|---|
| Anti-spent toner effect | 50,000 | 50,000 | 50,000 | 50,000 | 50,000 | 20,000 | 20,000 |
| Transfer properties | | | | | | | |
| Photoconductor (%) | 99.8 | 99.8 | 99.8 | 99.8 | 99.8 | 95 | 99 |
| Fixing ability | | | | | | | |
| Lower limit pressure ($kg/cm^2$) | 20 | 20 | 20 | 20 | 20 | 400 | 300 |
| Lower limit temperature (° C.) | 100 | 100 | 100 | 100 | 100 | 140 | 130 |
| Image sharpness | | | | | | | |
| Gradation | 16 | 16 | 16 | 16 | 16 | 8 | 8 |
| Thin-line resolution (dpi) | 600 | 600 | 600 | 600 | 600 | 300 | 300 |
| OHP light transmittance (%) | 95 | 95 | 95 | 95 | 95 | 90 | 92 |
| Preservation stability | ○ | ○ | ○ | ○ | ○ | X | X |

The conditions of the rubbing test were set 20 reciprocations under a load of 2 pounds (approximately 907 g). After rubbing, the initial image density before rubbing (A), the density of transfer onto unprinted paper (B), and a density of a non-image area of paper (C) were measured using a Macbeth type reflection densitometer, and the transfer rate was determined by the formula, [(B−C)/A×100(%)]. The lower limit fixing temperature and lower limit fixing pressure at which a transfer rate of 60% or more was exhibited were measured and compared.

(d) Image Sharpness

The image sharpness of each toner was compared and the gradation, thin-line resolution, and OBP light transmittance were evaluated as follows.

Gradation

The gradation was evaluated by gray scale steps of 0 to 16 using image samples made by Dataquest Co.

Thin-line Resolution

The thin-line resolving power was evaluated by a thin line pattern of 0 to 600 dpi using image samples made by Dataquest.

OHP Light Transmittance

An image was formed on an ORP film for PPC manufactured by Fuji Xerox, the light transmittance at an image

INDUSTRIAL APPLICABILITY

The toner for developing an electrostatically charged image of the present invention is a microcapsule toner particles composed of a core and a shell. Further, an olefin polymer having a cyclic structure which is relatively low in glass transition temperature and relatively low in average molecular weight is used as the binder resin in the core material and/or an olefin polymer having a cyclic structure which is relatively high in glass transition temperature and relatively high in number average molecular weight is used as the coating resin in the shell material.

Consequently the toner is applicable to pressure heating fixing type copying equipment and it is good in preservation stability, it produces sharp images of high grade, and it is excellent in anti-spent toner effect, transfer ability, fixing ability and offset-free properties.

Further, the toner of the present invention is excellent in exhibiting a sufficient fixing ability even in low-temperature heating type copying equipment.

Also, even with heat roller fixing type equipment, the use of the toner of this invention enables significant reduction of the heating calory to be achieved easily and thus enables contributions to be made for the energy savings of copying equipment.

Also, the supply of oil onto the heat roller surface is not needed by incorporating a function imparting agent for mold release such as silicone oil or wax into the shell material.

What is claimed is:

1. A toner for developing an electrostatically charged image, which comprises a microcapsule toner particle composed of a core and a shell, the core comprising a colorant and a binder resin containing an olefin copolymer having a cyclic structure, said olefin copolymer having a glass transition temperature ranging from −20° C. to less than 60° C. and a number average molecular weight ranging from 100 to 20,000, and the shell comprising a coating resin for the core.

2. The toner as claimed in claim 1, wherein the coating resin is at least one selected from the group consisting of a) homopolymers and copolymers of styrene and derivatives thereof, b) (meth)acrylic acid, c) maleic anhydride and derivatives thereof, d) vinyl monomers, e) vinylidene monomers, f) olefin monomers, g) condensation polymers, h) epoxy resins, i) polycarbonates, j) polyamides, k) polyurethanes, l) polyureas, m) rosin, and modified rosin, n) terpene resins, o) fatty hydrocarbon resins, and p) fatty cyclic hydrocarbon resins.

3. The toner as claimed in claim 1, wherein the binder resin is composed of at least one binder resin for heat fixing and selected from the group consisting of a) styrene polymers, b) copolymers of styrene monomer and (meth)acrylic ester, c) acrylic acid resins, d) polyester resins, and e) epoxy resins, and at least one binder resin for pressure fixing, selected from the group consisting of waxes, olefin polymers, styrene resins, epoxy resins, and polyester resins.

4. The toner as claimed in claim 3, wherein said waxes are vegetable, animal, mineral or petroleum.

5. The toner as claimed in claim 1, wherein the olefin copolymer having a cyclic structure which comprises the core material is modified by acrylic acid or maleic anhydride.

6. The toner as claimed in claim 1, wherein a wax is incorporated in said binder resin or said coating resin or said wax is incorporated in both said binder resin and said coating resin.

7. The toner as claimed in claim 6, wherein said wax is at least one selected from the group consisting of fatty acid amide waxes, oxidized polyethylene waxes and acid-modified polypropylene waxes.

8. The toner as claimed in claim 1, wherein silica micropowder is externally added or coated onto the surface of the microcapsule toner particle.

9. The toner as claimed in claim 1, wherein said coating resin is vinyl acetal, vinyl chloride or vinyl acetate.

10. A toner for developing an electrostatically charged image, which comprises a microcapsule toner particle composed of a core comprising a colorant and a binder resin; and a shell comprising a resin for coating the core containing an olefin copolymer having a cyclic structure, said olefin copolymer having a glass transition temperature ranging from 60° C. to 180° C. and a number average molecular weight ranging from 1,000 to 100,000.

11. The toner as claimed in claim 10, wherein the binder resin is composed of at least one binder resin for heat fixing and selected from the group consisting of a) styrene polymers, b) copolymers of styrene monomer and (meth)acrylic ester, c) acrylic acid resins, d) polyester resins, and epoxy resins, and at least one binder resin for pressure fixing, selected from the group consisting of waxes, olefin polymers, styrene resins, epoxy resins, and polyester resins.

12. The toner as claimed in claim 11, wherein said waxes are vegetable, animal, mineral or petroleum.

13. The toner as claimed in claim 10, wherein wax is incorporated in the binder resin or the coating resin or said wax is incorporated in both said binder resin and said coating resin.

14. The toner as claimed in claim 13, wherein said wax is at least one selected from the group consisting of fatty acid amide waxes, oxidized polyethylene waxes and acid-modified polypropylene waxes.

15. The toner as claimed in claim 10, wherein silica micropowder is externally added or coated onto the surface of the microcapsule toner particle.

* * * * *